United States Patent [19]

Walz, Sr.

[11] 4,363,419

[45] Dec. 14, 1982

[54] SELF-STORING PERMANENTLY ATTACHED CAN OPENING MEANS

[76] Inventor: Karl Walz, Sr., 24 Purchase St., Worcester, Mass. 01606

[21] Appl. No.: 300,052

[22] Filed: Sep. 8, 1981

[51] Int. Cl.[3] ..... B65D 41/32

[52] U.S. Cl. ..... 220/269

[58] Field of Search ..... 220/269–273

[56] References Cited

U.S. PATENT DOCUMENTS

| | | | |
|---|---|---|---|
| 3,744,667 | 7/1973 | Fraze et al. | 220/269 |
| 3,860,143 | 1/1975 | Strope et al. | 220/269 |
| 3,923,193 | 12/1975 | Wells et al. | 220/269 |
| 4,247,014 | 1/1981 | Walz | 220/269 |

*Primary Examiner*—George T. Hall

[57] ABSTRACT

This invention relates to self-storing can opening means suitable for permanent attachment to thin-walled metal beverage cans and incorporates a thin-walled metal cover for a can including an initially sealed flap portion thereof moveable to provide a raw edged circular access opening therethrough by means of an easily manually moveable pull tab permanently attached to the cover with a circular ring portion thereof initially secured in a first ready position adjacent to the cover and finally secured in a second protective position flush with the cover with its circular periphery deformably engaging and thereby sealing the circular peripheral raw edge of the access opening through the cover.

7 Claims, 4 Drawing Figures

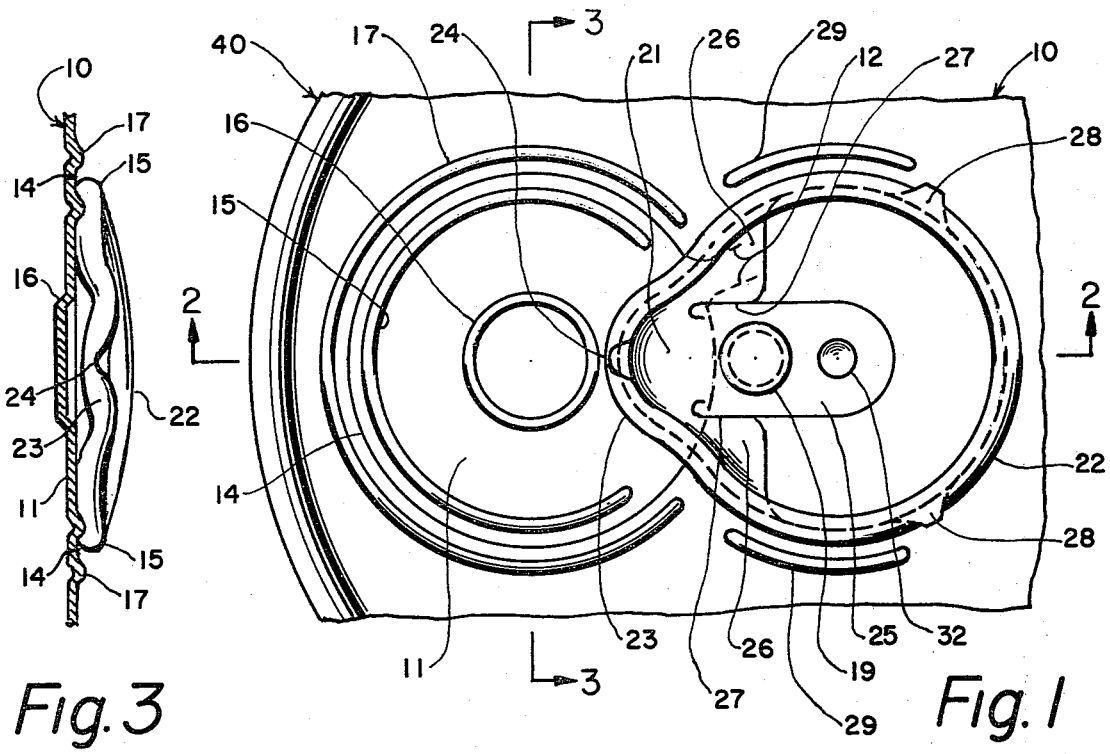
Fig. 3
Fig. 1
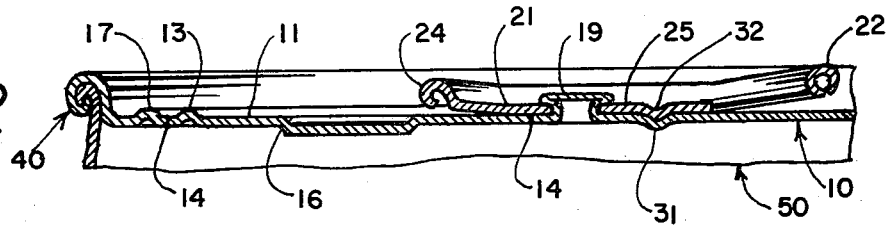
Fig. 2
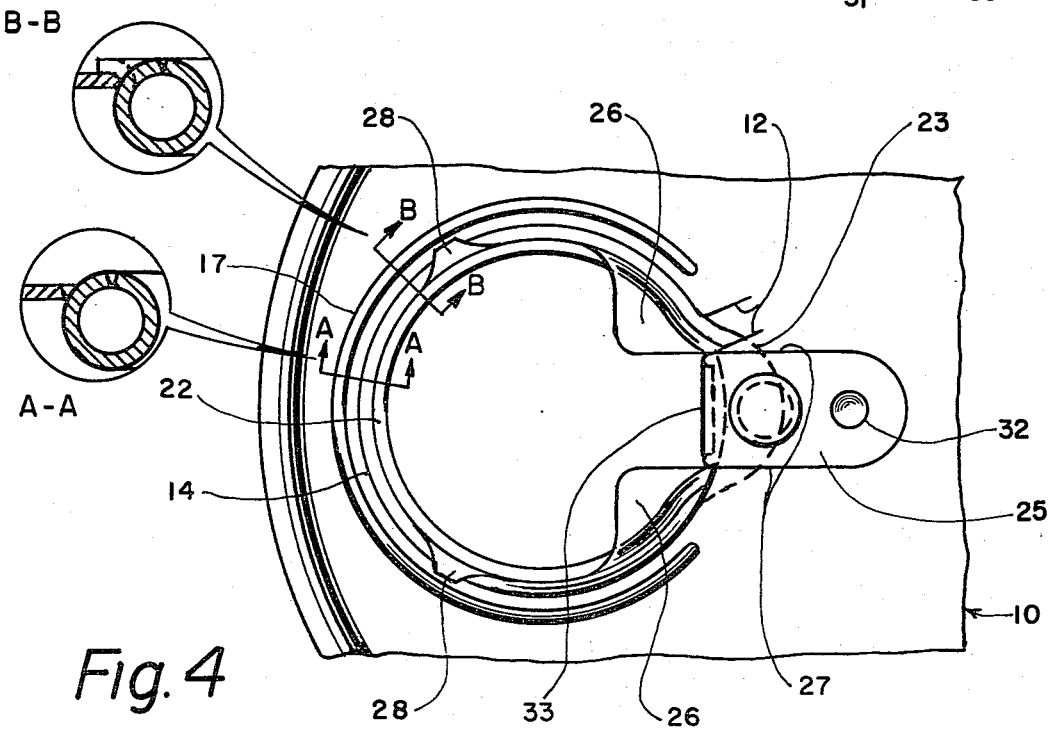
Fig. 4

SELF-STORING PERMANENTLY ATTACHED CAN OPENING MEANS

FIELD OF THE INVENTION

This invention relates to self-contained manually operable opening means for a hollow container, and particularly to a self-storing permanently attached opening means for a hollow container such as a thin-walled beverage can or the like.

BACKGROUND OF THE INVENTION

Since the first widespread use of thin-walled metal beverage cans, it has been the general practice to incorporate on one end of each can a self-contained opening means such as a pull tab connected to or cooperating with a tear flap with the pull tab arranged to be manually displaced to break open the tear flap and thereby release the contents from the can.

For example, in one of the most common early designs, the pull tab was connected directly to a tear flap designed to be pulled free of the can by manual operation of the annular pull tab to which the tear flap was attached. This configuration offered the user three poor alternatives; first, to discard immediately, usually on the ground, the detached tear flap and pull tab, the former with exposed raw metal edges, both unsightly and a serious hazard, especially in large quantities at beaches and other recreation facilities; second, to deposit the detached tear flap and pull tab inside the newly opened can before drinking the contents, a procedure creating a risk of ingesting the indigestible sharp edged tear flap with the contents of the can; and third, less likely, to hold on to the sharp edged tear flap and pull tab until the can is drained of its contents, and then deposit the tear flap and pull tab in the empty can for disposal therewith, with the possibility these loose parts inside will drop out of the can before it is deposited safely in a suitable trash receptacle.

More recently, the fully detachable tear flap and pull tab described above has been replaced by modified designs in which the pull tab is attached to the end of a can adjacent the tear flap and arranged to break open and rotate the tear flap inwardly of and still attached to a can to form an access opening therethrough, still presenting a raw metal edge relatively sharp and hazardous to someone using a can so equipped. Unfortunately, such "permanently attached pull tabs" usually made of thin sheet aluminum tend to remain sticking up from the end of the can adjacent the opening, so they are often torn loose with the same unfortunate alternatives described in the previous paragraph, often resulting in substantial quantities of undesirable pull tab discards underfoot, equally unsightly if less hazardous than the raw edged tear flaps. Even when such tabs are simply pushed back out of the way toward their initial ready position against the end of the can, they may break loose and depart unpredictably because the thin sheet aluminum of which they are usually made cracks very easily along the self-hinged portion of the pull tab.

An even more recent design configuration solved the problem of wayward pull tabs including those designed to remain permanently attached to the can, simply by eliminating the pull tab completely. Instead, a circular tear flap permanently attached to the can by a narrow self-hinged portion was rounded above the outer surface of the end of the can, to be broken open and displaced inwardly of the can to provide an access opening simply by the direct application of finger pressure to the rounded tear flap. Two serious problems remained. First, the exposed raw edge of the access opening posed a hazard to a user's finger pressed against the tear flap to open a can and a hazard to a user's lips placed against the access opening to drink from the can. Second the fully exposed and relatively raised tear flap, necessarily made relatively easy to break open by finger pressure, was too easily broken open by an accidental bump or blow during shipment and handling of large quantities of cans so fitted, or on display in stores by busy little fingers.

SUMMARY OF THE INVENTION

The substantially modified design described, illustrated and claimed in U.S. Pat. No. 4,247,014 issued Jan. 27, 1981 to this inventor provides various features together intended to overcome all of the problems described above, but both modifications of the design described therein are characteristically relatively more complex, and hence relatively more costly and more difficult to manufacture, than is desirable for a device intended to be used once and then be discarded.

The design embodied in the instant invention is relatively simpler and more compact and thence easier and less costly to manufacture; and furthermore incorporates design refinements contributing to substantially enhanced performance; all as compared to its predecessor design described in U.S. Pat. No. 4,247,014 referred to hereinabove.

More particularly, it is the purpose of this invention to provide a compact conveniently shaped pull tab including a finger sized circular ring portion hingedly supported by a pull tab mounting portion in fact permanently attached to the thin-walled cover on the end of a can, and in turn supporting a relatively smaller flap actuating portion so located adjacent to a circular flap portion of the cover it operates first to break open the flap portion and then to rotate the flap portion inwardly of the can to form a circular access opening through the cover, as the pull tab initially fixedly secured in its first ready position is moved quite readily manually along a predetermined arcuate path into and thereafter fixedly secured in its second protective position finally fully constrained in sealed engagement with substantially the entire raw edge of the access opening through the cover of the can.

BRIEF DESCRIPTION OF THE DRAWINGS

The distinctive features of the present invention are all shown in the several drawings herewith, identified as follows:

FIG. 1 is a top plan view, partially broken away, showing the preferred embodiment of a thin-walled cover for a beverage can arranged to incorporate the instant invention, and a manually operable pull tab attached thereto in its initial ready position in operative relation to a flap portion of the cover, FIG. 2 is a vertical section, partially broken away, on section line 2—2 of FIG. 1, through the cover and lengthwise of the pull tab attached thereto, with the pull tab in its initial ready position, shown also in FIG. 1, FIG. 3 is a vertical section, partially broken away, on section line 3—3 of FIG. 1, through the cover and transversely of the pull tab attached thereto showing the pull tab in its initial ready position with its flap actuating portion spaced slightly away from the flap portion of the cover, and FIG. 4 is a top plan view, partially broken away, corresponding to the showing in FIG. 1, but with the manually operable pull tab in its final protective position flush with the cover and with its periphery engaged with the periphery of the access opening through the cover, created by displacement of the flap portion thereof, said figure also including detailed vertical sections A—A and B—B showing structural details.

DETAILED DESCRIPTION OF THE INVENTION

Referring now more particularly to the showing in each of the respective drawings, wherein like reference numerals refer to like or corresponding parts, these drawings together illustrate the various significant features of a desirable arrangement for first closing and sealing a hollow container to secure, protect and preserve its contents, and thereafter actuating manually operable means for opening the hollow container to release pourable contents therefrom.

For example, in the case of a hollow container comprising a cylindrical thin-walled beverage can fabricated from suitable sheet metal, plastic, or the like, the circular cover 10 may be permanently attached to a beverage can, generally designated by FIG. 50 in FIG. 2, by rolling and sealing together the respective peripheral edges of the cover 10 and the opening in the can 50 to form the continuous joint 40 in the manner already well-known in the art, as shown in section in FIG. 2.

The cover 10 includes a circular flap portion 11 thereof delineated by a scored peripheral edge 14 with its opposite ends 12 respectively oppositely hooked to form the sides of a first flexible narrow self-hinged portion interconnecting relatively moveable flap portion 11 and the relatively fixed surrounding portion of the cover 10. As shown in FIG. 1 and elsewhere, the periphery of the circular flap portion 11 is stiffened by a raised circular rib 15, and the center of the flap portion 11 is stiffened by an off-set circular depression 16 therein, while the surrounding portion of the cover 10 is stiffened by a raised rib 17 closely encircling the flap portion 11, and by a pair of raised ribs 29 respectively adjacent the opposite sides of pull tab 21.

It will be apparent either raised or depressed ribs and either depressed or raised off-set sections such as depression 16 are generally equally effective as means of stiffening those parts of the thin-walled cover 10 wherever increased resistance to local bending is required. For example, see the relevant showings of raised ribs and alternative off-set depressions in the several drawings of U.S. Pat. No. 4,247,014 illustrating such alternative configurations.

Still referring to FIG. 1, a cooperating pull tab 21 is shown as consisting of a circular annular ring portion 22 with a circular cross section around at least half its circumference, as shown best in FIG. 2 and in sections A—A and B—B of FIG. 4, supporting a relatively smaller flap actuating portion 23 extending radially outwardly therefrom, transversely shaped to form substantially a point of contact 24 and initially supported safely spaced slightly out of engagement with flap portion 11. See FIG. 3 and FIG. 2, respectively. The annular ring portion 22 of the pull tab is in turn supported by a pull tab mounting portion 25 extending radially inwardly therefrom and adjacent the outer surface of the cover 10, secured in the position shown in FIG. 1 by suitable attachment means such as a self-rivet 19 formed centrally of cover 10 and flattened against pull tab mounting portion 25 further secured from rotation about self-rivet 19 by suitable interfitted and coacting restraining means such as dimples 31 and 32 respectively formed in cover 10 and in pull tab mounting portion 25, as shown best in FIG. 2 and also in FIGS. 1 and 4.

The webs 26, shown in FIG. 1 initially interconnecting the opposite sides 27 of the pull tab mounting portion 25 and adjacent sections of the annular ring portion 22 to secure pull tab 21 fixedly in its ready position, are respectively scored or partially sheared along the opposite sides 27 of the pull tab mounting portion 25, so they may be broken loose by deliberate manual movement of the pull tab 21 from its first ready position to its second protective position shown in FIG. 4, arcuately about the self-hinged portion 33 extending transversely of the pull tab 21 and substantially chordwise of the scored edge 14 of flap portion 11, as shown in FIG. 4.

FIG. 1 also shows, on annular ring portion 22, spaced radially outwardly extending projections 28 each formed by rolling outwardly a short circumferential section or the outer edge of annular ring portion 22 elsewhere rolled inwardly toward the outwardly rolled inner edge of annular ring portion 22, which edges rolled toward and against each other form the circular cross section of the annular ring portion, as shown in FIG. 2 and in detailed vertical section A—A of FIG. 4.

FIG. 2 shows best the sort of rolled peripheral edge seam generally designated by reference numeral 40 by means of which the thin-walled cover and the thin-walled can, respectively designated by reference numerals 10 and 50, are sealably interconnected in the manner well-known in the art; the manner in which the flap actuating portion 23 of pull tab 21 is bent up slightly to provide a small clearance between its point contact 24 and the flap portion 11 adjacent off-set depression 16, in order to avoid accidental breakaway of the scored edge 14 of flap portion 11; and the manner in which the free side of annular ring portion 22 of the pull tab 21 is bent up slightly to facilitate its deliberate engagement by a user's finger.

FIG. 3 shows how the opposite sides of the flap accuating portion 23 of the pull tab 21 are bent up to form the central point contact 24, shown spaced slightly away from the adjacent outer surface of the flap portion 11 of cover 10 when the pull tab 21 is secured in its first ready position.

In FIG. 4, the pull tab 21 is shown in its second protective position with the periphery of the annular ring portion thereof in sealed engagement with substantially the entire peripheral edge of the access opening formed by breaking away peripheral edge 14 of the flap portion 11 and rotating the flap portion out of sealed engegement with the surrounding relatively fixed portion of the cover 10, and with a predetermined arcuate section of the periphery of said pull tab engaging the inner surface of the cover adjacent to and beneath a corresponding arcuate section of the peripheral edges of the access opening through the cover; the projections 28 extending radially outwardly from the arcuate ring portion 22 of the pull tab 21 are shown overlying and in engagement with the outer surface of the cover 10 adjacent the peripheral edge of the access opening therethrough; and the flap actuating portion 23 of the pull tab 21 is shown disposed underneath the cover 10 and thereby located entirely within the can and completely out of the way.

More particularly, detailed vertical section A—A of FIG. 4 shows exactly the relative positions of coacting predetermined arcuate sections of the cover 10 and the annular ring portion 22 with the pull tab 21 disposed in its second protective position. Movement of the circular annular ring portion 22, formed substantially equal in size to, but incrementally larger than, the cooperating circular peripheral edge of the access opening through the cover 10, into the final protective position shown in this detailed view is accomplished by slight deflection of self-hinged portion 33 supporting pull tab 21 followed by slight spring back of self-hinged portion 33, producing a wiping action by which the peripheral raw edge of the access opening through cover 10 is deformed slightly into sealed engagement with the periphery of circular annular ring 22, a predetermined angular section of which periphery lies slightly beneath cover 10, and thus in engagement with the inside surface thereof.

Again more particularly, detailed vertical section B—B of FIG. 4 shows most clearly the manner in which each projecting portion 28 is rolled radially outwardly of annular ring portion 22 rather than radially inwardly to form a circular cross section as are the adjoining sections of annular ring portion 22.

Collectively, the several drawings disclose a relatively simple and conveniently compact design for a pull tab, which can be manufactured quickly and easily, using suitable progressive dies, from a minimum quantity of thin sheet metal strips, with the pull tab blanks supported at succeeding die stations by at least two supporting tabs interconnecting each pull tab blank and the surrounding thin sheet metal strip until the tabs are finally severed to release the completed pull tab blank and to leave formed therefrom projecting portions 28 extending radially outwardly from the annular ring portion 22 of the finished pull tab 21.

OPERATION OF THE INVENTION

As indicated above, beverage cans 50 enclosed and sealed by covers 10 provided with circular flap portions 11 and fitted with permanently attached pull tabs 21 each fixedly secured in its first ready position can be safely shipped, stored and handled in large quantities with minimum risk of premature accidental opening of any flap portion 11, due to the constraint imposed by webs 26 on the flap actuating portion 23 initially positioned and maintained with point contact 24 spaced slightly from the outer surface of flap portion 11 of cover 10 and operative about self-hinged portion 33 through a relatively shorter moment arm.

Conversely, deliberate manual displacement of the circular annular ring portion 22 away from its first ready position adjacent the cover 10 and thereafter arcuately about self-hinged portion 33 through a relatively longer moment arm to open flap portion 11 of cover 10 is accomplished relatively more easily than many prior pull tab designs. The relative ease with which the pull tab 21 of the instant invention is manually displaced to open a can to which it is attached has been and can be demonstrated by so manipulating an assembly comprising a full scale cover and pull tab unit constructed, arranged and operated entirely according to the teachings of this invention. Moreover, this satisfactory result has been achieved without resort to special supplemental scored parting lines immediately adjacent the attachment rivet and arranged to break away responsive to the initial effort to displace the pull tab manually, in order to vent the can before the flap portion of the cover can be broken open.

Finally, manual movement of the pull tab 21 along a predetermined arcuate path, determined by the proper fixed position of pull tab mounting portion 25 maintained so positioned by coacting dimples 31 and 32, precisely aligns incrementally larger circular annular ring portion 22 with the coacting circular peripheral edge of the access opening through cover 10. Thereafter, only slight additional pressure on annular ring portion 22, safely applied by the user's finger engaging the circular cross section of the annular ring portion, is sufficient to lock the pull tab 21 in its last protective position with a predetermined part of the periphery of the annular ring portion thereof securely interfitted with and fully constrained by a corresponding part of the peripheral edge of the access opening through the cover 10.

Incidentally, arcuate movement of the pull tab 21 one way only between its ready position and its final fixed position is facilitated by so shaping the sides of the pull tab each is relieved about three thousandths of an inch along the short transition section thereof between the circular periphery of the annular ring portion 22 and the arcuately curved periphery of the flap actuating portion 23, an amount similar to the diametrical amount by which the circular annular ring portion 23 is incrementally larger than the circular access opening.

SUMMARY

Thus, the present invention provides a self-storing permanently attached can opening means environmentally acceptable and safer to use because the can opening means is especially designed and constructed to remain securely attached to the can after it is used to open the can, an opening means particularly useful on a beverage can, because it is self-storing against the end of the can both in its initial ready position and in its final protective position, after the can is opened, with its circular annular ring portion sealed fixedly against and protecting the circular raw edge of the access opening through the can cover, thus entirely safe both in use and for disposal.

What is claimed is:

1. On a hollow container for pourable contents contained therein sealably closed by a thin-walled cover therefor, and having attached thereto manually operable opening means therefor, the combination on the thin-walled cover thereof, of:

a relatively movable flap portion delineated by a continuously arcuately curved breakaway peripheral edge with mutally spaced hooked ends together defining a first self-hinged portion flexibly supporting the flap portion of said cover for movement from a first stored position in sealed engagement with the surrounding relatively fixed portion of said cover to a second open position substantially perpendicular to the surrounding relatively fixed portion of said cover and within a container to which said cover is attached, a pull tab having an annular ring portion with a continuously arcuately curved periphery so shaped and sized it may be mutually engaged and interfitted with the continuously arcuately curved edge of the access opening through said cover provided by rotating said flap portion from its first to its second position, said annular ring portion of said pull tab supporting a relatively smaller flap actuating portion projecting outwardly therefrom and being supported resiliently by a pull tab mounting portion projecting inwardly therefrom to which said annular ring portion is connected by a second flexible self-hinged portion for manually actuated movement from a first ready position with the annular ring portion of said pull tab disposed adjacent to and spaced slightly from the outer surface of said cover to a second protective position with its periphery mutually engaged and interfitted with the edge of the access opening through said cover, and attachment means securely connecting said pull tab mounting portion of said pull tab to said cover with the flap actuating portion of said pull tab overlying said flap portion of said cover, whereby manual movement of said pull tab from its first ready position to its second protective position so moves the flap actuating portion of said pull tab as to move the flap portion of said cover from its first stored position sealably closing said cover to its second open position to release the pourable contents of a container to which said cover is attached.

2. A device as described in claim 1, and, in addition:

first constraining means projecting outwardly from the periphery of the annular ring portion of said pull tab and arranged to be engaged by the outer surface of the relatively fixed surrounding portion of said cover adjacent the edge of the access opening therethrough when the periphery of the annular ring portion of said pull tab is moved into engagement with the peripheral edge of the access opening through said cover and slightly therebeyond into engagement with the inner surface of said cover adjacent the peripheral edge of the access opening therethrough, whereby said pull tab is immobilized in its second protective position substantially flush with said cover and is thereby prevented from passing entirely through the access opening through said cover into a container to which said cover is attached.

3. A device as described in claim 2, and, in addition:

second constraining means initially interconnecting the annular ring portion and the pull tab mounting portion of said pull tab so shaped and arranged as to resist movement of said annular ring portion relative to said pull tab mounting portion, and thereby, to resist movement of said pull tab arcuately about said second self-hinged portion, said second constraining means including a section thereof of predetermined reduced strength arranged to be broken away by deliberate initial manual movement of said pull tab out of its first ready position and thereafter readily toward its second protective position.

4. A device as described in claim 3, and, in addition:

third constraining means for said pull tab comprising first and second coacting retaining means respectively offset from mutually adjacent surfaces of said cover and the pull tab mounting portion of said pull tab, so interfitted and mutually engaged as to fixedly constrain said pull tab from rotation about said attachment means relative to said cover, whereby said pull tab initially fixedly constrained in its first ready position and finally fixedly constrained in its second protective position is further constrained so as to be moved manually along a predetermined arcuate path directly and precisely from the first ready position to the second protective position of said pull tab, as the flap portion of said cover is thereby moved from its first stored position to its second open position.

5. In combination with a hollow container for a quantity of liquid or other pourable contents, initially provided with an opening therethrough for filling the container, and arranged to be enclosed and sealed by a cover for the opening therethrough attached permanently to the container to secure, protect and preserve its contents, a thin-walled cover for a hollow container including a circular flap portion having a scored peripheral edge thereof partially cut through the cover and having oppositely hooked ends thereof forming the respective mutually spaced sides of a narrow hinge portion flexibly interconnecting the circular flap portion and the surrounding fixed portion of said cover to which it is thereby attached, as the circular flap portion is rotated from a first closed position in sealed engagement with the fixed portion of said cover and a second open position extending inwardly from beneath the fixed portion of said cover into a hollow container to which it is attached, in order to provide an unobstructed circular access opening through said cover, a pull tab permanently attached to said thin-walled cover adjacent to the circular flap portion thereof, said pull tab including a relatively larger generally circular annular ring portion also of circular cross section at least along a semi-circular first side of the annular ring portion of said pull tab, thus so shaped and arranged as to be engaged comfortably by a person's finger for its manual movement in one direction only from a first ready position of said pull tab in which it is stored with the semi-circular first side of its annular ring portion disposed closely adjacent to but spaced from the outer surface of said cover to a second protective position of said pull tab with a predetermined portion of the periphery of the semi-circular first side of its annular ring portion engaging and slightly beneath the adjacent semi-circular side of the circular access opening through said cover, formed by displacing the flap portion thereof, to maintain the annular ring portion of said pull tab disposed generally concentrically within and adjacent to substantially the entire peripheral raw edge of the circular opening, said pull tab also including a relatively smaller flap actuating portion extending radially outwardly from an opposite side of its annular ring portion, initially positioned overlying but out of engagement with an adjacent section of said circular flap portion and moveable with the annular ring portion of said pull tab, first to break open and then to rotate said flap portion inwardly of a hollow container to which said cover is attached and finally positioned beneath said cover, said pull tab additionally including a pull tab mounting portion extending radially inwardly from the opposite second side of its annular ring portion disposed in mutual engagement with the outer surface of said cover, and attachment means securely connecting the pull tab mounting portion of said pull tab permanently to said cover adjacent to said flap portion thereof.

6. A device as described in claim 5, wherein:

the flap actuating portion and the pull tab mounting portion of said pull tab, respectively extending radially outwardly and inwardly of its annular ring portion are interconnected by a flexible hinge means extending transversely thereof, and the outside diameter of the circular annular ring portion of said pull tab is substantially equal to and incrementally larger than the diameter of the periphery of the circular access opening through said cover formed when said flap portion is broken open and rotated out of sealed engagement with the surrounding fixed portion of said cover, whereby initial deflection and subsequent spring-back of said transversely extending flexible hinge means allows a peripheral portion of the first semi-circular side of the annular ring portion of said pull tab to be positioned and maintained in engagement with and slightly beneath the corresponding peripheral portion of the circular access opening through said cover and thereby deform the peripheral raw edge of said access opening into sealable engagement with substantially the entire periphery of the annular ring portion of said pull tab except immediately adjacent the opposite ends of said transversely extending flexible hinge means.

7. A device as described in claim 6, wherein:

the circular annular ring portion of said pull tab includes mutually spaced pull tab constraining means projecting radially outwardly from the annular ring portion of said pull tab adjacent the surface of the annular ring portion disposed nearest said cover when said pull tab is located in its first ready position, and arranged for restraining engagement with the outer surface of said cover adjacent to the circular access opening therethrough when said pull tab is located in its second protective position with a peripheral portion of the annular ring portion positioned in engagement with and slightly beneath the corresponding peripheral portion of the circular access opening, whereby said pull tab is prevented from passing completely through the circular access opening, is constrained in proper protective relation to the raw edge of the circular access opening in the second protective position of said pull tab, and is maintained securely in engagement with and disposed flush with said cover for safest use and subsequent disposal of a hollow container with said pull tab attached thereto.

* * * * *